US010000068B2

(12) United States Patent
Fujiwara

(10) Patent No.: US 10,000,068 B2
(45) Date of Patent: Jun. 19, 2018

(54) MULTI-DROP INKJET PRINTING APPARATUS

(71) Applicant: RISO KAGAKU CORPORATION, Tokyo (JP)

(72) Inventor: Daisuke Fujiwara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days. days.

(21) Appl. No.: 15/618,342

(22) Filed: Jun. 9, 2017

(65) Prior Publication Data

US 2018/0022107 A1 Jan. 25, 2018

(30) Foreign Application Priority Data

Jul. 20, 2016 (JP) ..... 2016-142174

(51) Int. Cl.
*B41J 2/21* (2006.01)
*B41J 2/045* (2006.01)
*B41J 29/393* (2006.01)

(52) U.S. Cl.
CPC ..... *B41J 2/2132* (2013.01); *B41J 2/04593* (2013.01); *B41J 2/2103* (2013.01); *B41J 29/393* (2013.01)

(58) Field of Classification Search
CPC ..... B41J 29/393; B41J 2/2132; B41J 2/04593
See application file for complete search history.

(56) References Cited

U.S. PATENT DOCUMENTS

2007/0106962 A1* 5/2007 Sakakibara ..... H04N 1/58 716/100

FOREIGN PATENT DOCUMENTS

| | | | |
|---|---|---|---|
| JP | 2003-266667 | | 9/2003 |
| JP | 2014139005 A | * | 7/2014 |
| JP | 2015003413 A | * | 1/2015 |
| JP | 2015047727 A | * | 3/2015 |

* cited by examiner

*Primary Examiner* — Sharon A Polk
(74) *Attorney, Agent, or Firm* — Greenblum & Bernstein, P.L.C.

(57) ABSTRACT

A controller changes a droplet number larger than a second maximum droplet number among droplet numbers in first droplet data for each ink color to the second maximum droplet number. The controller, for each of certain pixels with a droplet number of black decreased to the second maximum droplet number, performs at least one of a first processing or a second processing. The first processing includes distributing a droplet number subtracted to decrease the droplet number of black to pixels surrounding the certain pixel in the first droplet data for black. The second processing includes adding the subtracted droplet number to a droplet number for the certain pixel in the first droplet data for a color other than black.

6 Claims, 6 Drawing Sheets

31

| SHEET TYPE | PRINT RESOLUTION (dpi) | STANDARD MAXIMUM DROPLET NUMBER |
|---|---|---|
| ORDINARY SHEET | 300 | 5 |
| | 600 | 3 |
| MATTE SHEET | 300 | 6 |
| | 600 | 4 |
| GLOSS SHEET | 300 | 7 |
| | 600 | 5 |

32

| PRINT SPEED MODE | DROPLET SUBTRACTION NUMBER |
|---|---|
| STANDARD MODE | 0 |
| FIRST HIGH-SPEED MODE | 1 |
| SECOND HIGH-SPEED MODE | 2 |
| THIRD HIGH-SPEED MODE | 3 |

FIG. 8A

| | | COLOR TO BE ACHIEVED | | | | | | |
|---|---|---|---|---|---|---|---|---|
| | | RED (R) | GREEN (G) | BLUE (B) | CYAN (C) | MAGENTA (M) | YELLOW (Y) | BLACK (K) |
| INK USAGE (%) | CYAN (C) | 0 | 80 | 80 | 100 | 0 | 0 | 20 |
| | MAGENTA (M) | 80 | 0 | 80 | 0 | 100 | 0 | 20 |
| | YELLOW (Y) | 80 | 80 | 0 | 0 | 0 | 100 | 20 |
| | BLACK (K) | 0 | 0 | 0 | 0 | 0 | 0 | 100 |

FIG. 8B

| | | COLOR TO BE ACHIEVED | | | | | | |
|---|---|---|---|---|---|---|---|---|
| | | RED (R) | GREEN (G) | BLUE (B) | CYAN (C) | MAGENTA (M) | YELLOW (Y) | BLACK (K) |
| INK USAGE (%) | CYAN (C) | 0 | 80 | 80 | 80 | 0 | 0 | 26 |
| | MAGENTA (M) | 80 | 0 | 80 | 0 | 80 | 0 | 26 |
| | YELLOW (Y) | 80 | 80 | 0 | 0 | 0 | 80 | 26 |
| | BLACK (K) | 0 | 0 | 0 | 0 | 0 | 0 | 80 |

MULTI-DROP INKJET PRINTING APPARATUS

CROSS REFERENCE TO RELATED APPLICATION

This application is based upon and claims the benefit of priority from the prior Japanese Patent Application No. 2016-142174, filed on Jul. 20, 2016, the entire contents of which are incorporated herein by reference.

BACKGROUND

1. Technical Field

The disclosure relates to a multi-drop inkjet printing apparatus.

2. Related Art

As one of printing methods, there is an inkjet method in which ink droplets are ejected from nozzles in inkjet heads and made to land on a sheet to form an image.

Japanese Unexamined Patent Application Publication No. 2003-266667 describes, as one of inkjet methods, a multi-drop method in which each nozzle is made capable of ejecting multiple ink droplets onto each pixel. The multi-drop method employs gradation printing in which density is expressed by the number of ink droplets (droplet number) ejected for each pixel.

SUMMARY

In a multi-drop inkjet printing apparatus, a maximum droplet number is determined depending on a sheet type and a print resolution. The maximum droplet number is the maximum number of droplets of ink of each color per pixel. The larger the receivable ink amount of the sheet type, the larger the maximum droplet number. Moreover, the higher the print resolution, the larger the number of pixels per unit area and thus the smaller the maximum droplet number.

In an inkjet printing apparatus which performs printing on a sheet with multi-drop inkjet heads while conveying the sheet, the conveyance speed of the sheet is determined depending on the maximum droplet number. The larger the maximum droplet number, the longer the time required from the start to the end of ejection per pixel. Hence, as the maximum droplet number becomes larger, the conveyance speed of the sheet is set to a lower speed.

The maximum droplet number thus determines the productivity of printed sheets. Setting the maximum droplet number in printing to a number smaller than the maximum droplet number determined depending on the sheet type and the print resolution leads to the high conveyance speed of the sheet and improvement of the productivity of the printed sheets. However, simply reducing the maximum droplet number may cause a decrease in print image quality due to a decrease in the density of the printed images and the like.

An object of the disclosure is to provide an inkjet printing apparatus which can improve the productivity of printed sheets while suppressing a decrease in image quality.

An inkjet printing apparatus in accordance with some embodiments includes: a conveyor configured to convey a sheet; a printer including a multi-drop inkjet head and configured to eject inks of multiple colors including black onto the sheet conveyed by the conveyor from the inkjet head to perform printing on the sheet; and a controller configured to control the conveyor and the printer. The controller is configured to: determine a maximum droplet number of an ink of each color per pixel to be a second maximum droplet number smaller than a first maximum droplet number corresponding to a print condition; correct first droplet data for each ink color to second droplet data for each ink color, the first droplet data indicating a droplet number of the ink per pixel with the first maximum droplet number set as maximum, the second droplet data indicating the droplet number of the ink per pixel with the second maximum droplet number set as maximum; control the conveyor to convey the sheet at a conveyance speed for the second maximum droplet number; and control the printer to eject the inks of the respective colors from the inkjet head based on the second droplet data. Correcting the first droplet data to the second droplet data includes: changing a droplet number larger than the second maximum droplet number among droplet numbers in the first droplet data for each ink color, to the second maximum droplet number; and for each of certain pixels with the droplet number of black decreased to the second maximum droplet number, performing at least one of a first processing or a second processing, the first processing including distributing a droplet number subtracted to decrease the droplet number of black to pixels surrounding the certain pixel in the first droplet data for black, the second processing including adding the subtracted droplet number to a droplet number for the certain pixel in the first droplet data for a color other than black.

In the configuration described above, the new maximum droplet number smaller than the maximum droplet number corresponding to the print condition is set, the maximum droplet number of the ink per pixel in the droplet data for each ink color is corrected to be the new maximum droplet number, the conveyor is controlled to convey the sheet at the conveyance speed for the new maximum droplet number, and the printer is controlled to eject the inks of the respective colors based on the corrected pieces of droplet data for the respective colors. The printing is thus performed while conveying the sheet at the conveyance speed for the new maximum droplet number smaller than the maximum droplet number corresponding to the print condition. Accordingly, the printing can be performed with the conveyance speed of the sheet increased. As a result, the productivity of printed sheets can be improved.

Moreover, for each of the certain pixels for which the droplet number of black is decreased to the new maximum droplet number, there is performed at least one of the processing of distributing a droplet subtracted to decrease the droplet number of black to a pixel surrounding the certain pixel in the droplet data for black, and the processing of replacing the subtracted droplet with a droplet for the certain pixel in the droplet data for another color. This can suppress a decrease in the amount of ink(s) used to achieve a color close to black when the maximum droplet number in the printing is reduced. Hence, a decrease in the density of the color close to black in a printed image can be suppressed.

Accordingly, the configuration described above can improve the productivity of printed sheets while suppressing a decrease in print image quality.

The controller may select and determine one of a plurality of droplet numbers as the second maximum droplet number.

In the configuration described above, since one of the multiple print speeds (productivity) and the print image quality corresponding thereto can be selected and set, the usability is improved.

The print condition may include at least one of a type of the sheet and a print resolution.

The conveyance speed for the second maximum droplet number may be higher than a conveyance speed for the first maximum droplet number.

The inkjet printing apparatus may further include a storage storing a first table and a second table, the first table associating the print condition with the first maximum droplet number, the second table associating each of a plurality of print speed modes for use to set a print speed with a droplet subtraction number for correcting the first droplet data to the second droplet data.

In the first processing, the controller may distribute the subtracted droplet number preferentially to a pixel with a larger droplet number among the pixels surrounding the certain pixel.

BRIEF DESCRIPTION OF DRAWINGS

FIG. 8A is a table for explaining changes in ink usages of various colors caused by performing the droplet data correction processing.

FIG. 8B is a table for explaining the changes in the ink usages of the various colors caused by performing the droplet data correction processing.

DETAILED DESCRIPTION

Figure 1:
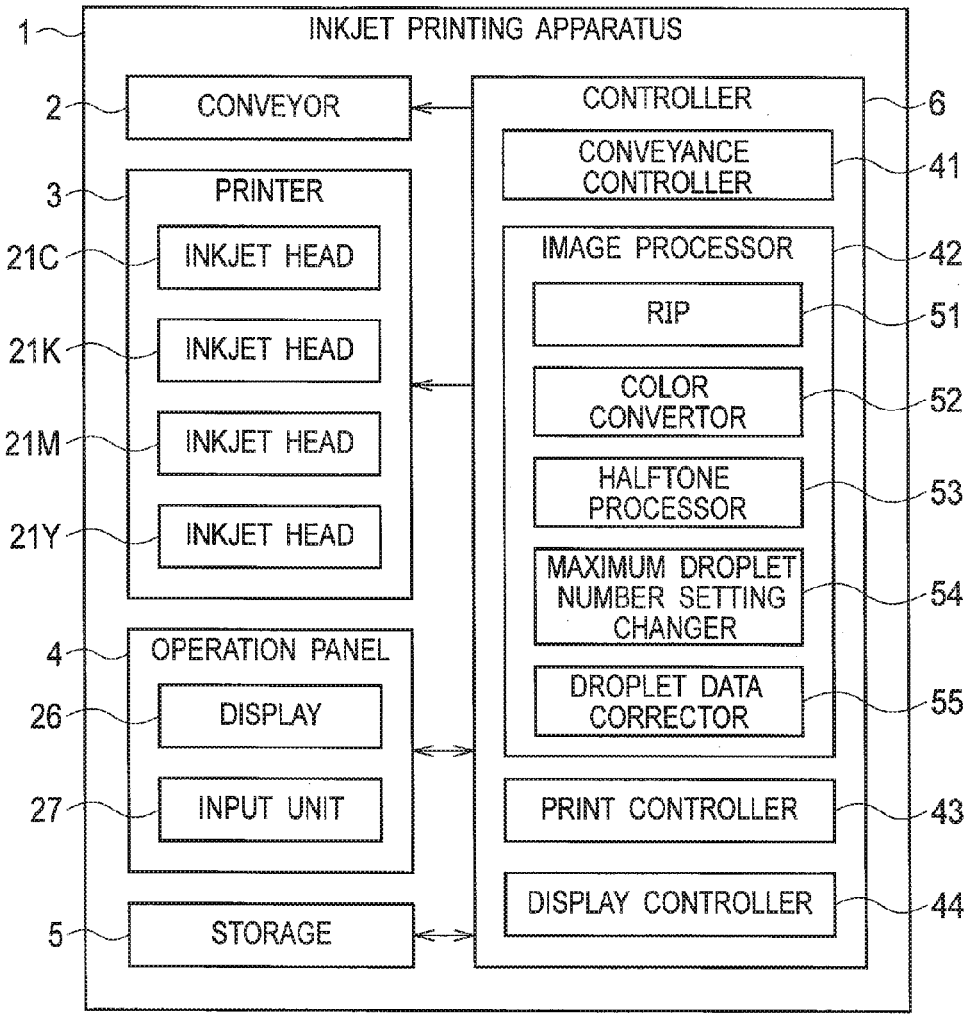
FIG. 1 is a block diagram illustrating a configuration of an inkjet printing apparatus in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figures 2, 3:
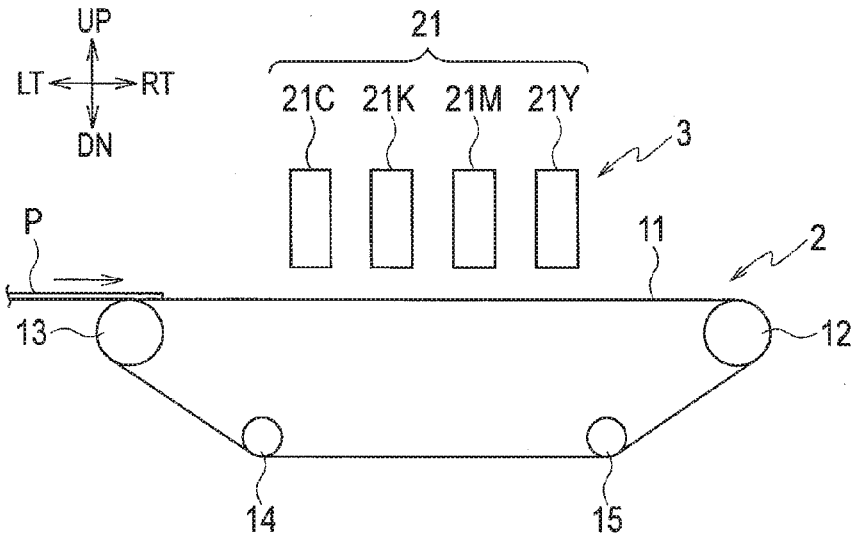
FIG. 2 is a schematic configuration diagram of a conveyor and a printer in the inkjet printing apparatus illustrated in FIG. 1.
FIG. 3 is a diagram illustrating a maximum droplet number table.

FIG. 1 is a block diagram illustrating a configuration of an inkjet printing apparatus 1 in an embodiment of the present invention. FIG. 2 is a schematic configuration diagram of a conveyor 2 and a printer 3 in the inkjet printing apparatus 1 illustrated in FIG. 1. In FIG. 2, right, left, up, and down, are denoted by RT, LT, UP, and DN, respectively.

As illustrated in FIG. 1, the inkjet printing apparatus 1 in the embodiment includes the conveyor 2, the printer 3, an operation panel 4, a storage 5, and a controller 6.

The conveyor 2 conveys a sheet P which is a print medium fed from a not-illustrated paper feeder. A direction from left to right in FIG. 2 is a conveyance direction of the sheet P. The conveyor 2 includes a conveyor belt 11, a drive roller 12, and driven rollers 13, 14 and 15.

The conveyor belt 11 conveys the sheet P while sucking and holding the sheet P. The conveyor belt 11 is an annular belt wound around the drive roller 12 and the driven rollers 13 to 15. Many belt holes for sucking and holding the sheet P are formed in the conveyor belt 11. The conveyor belt 11 sucks and holds the sheet P on an upper surface thereof by using sucking force generated at the belt holes by drive of a fan (not illustrated). The conveyor belt 11 is rotated clockwise in FIG. 2 to convey the sucked and held sheet P in the direction from left to right in FIG. 2.

The drive roller 12 rotates the conveyor belt 11. The drive roller 12 is driven by a not-illustrated motor.

The driven rollers 13 to 15 support the conveyor belt 11 together with the drive roller 12. The driven rollers 13 to 15 are driven by the drive roller 12 via the conveyor belt 11. The driven roller 13 is arranged on the left side of the drive roller 12 at the same height as the drive roller 12. The driven rollers 14 and 15 are arranged below the drive roller 12 and the driven roller 13, at the same height while being spaced away from each other in a left-right direction.

The printer 3 elects inks to the sheet P conveyed by the conveyor 2 to print an image. The printer 3 includes inkjet heads 21C, 21K, 21M, and 21Y. Note that, in the following description, the inkjet heads 21C, 21K, 21K, and 21Y are sometimes generally referred to by omitting the attached alphabets (C, K, M, and Y).

Each of the inkjet heads 21 ejects an ink to the sheet P conveyed by the conveyor 2. Each inkjet head 21 has multiple nozzles (not illustrated) aligned in a main scanning direction orthogonal to a conveyance direction of the sheet P, and ejects the ink from the nozzles. The inkjet heads 21 are multi-drop inkjet heads which can eject multiple ink droplets from each nozzle per pixel, and performs gradation printing in which density is expressed by the number of ink droplets (droplet number). The inkjet heads 21C, 21K, 21M, and 21Y eject a cyan (C) ink, a black (K) ink, a magenta (M) ink, and a yellow (Y) ink, respectively.

The operation panel 4 displays various input screens and the like and receives input operations made by a user. The operation panel 4 includes a display 26 and an input unit 27.

The display 26 displays the various input screens and the like. The display 26 includes a liquid crystal display panel and the like.

The input unit 27 receives input operations made by the user and outputs operations signals corresponding to the operations. The input unit 27 includes various operation keys, a touch panel, and the like.

The storage 5 stores various programs and the like. The storage 5 stores a maximum droplet number table 31 illustrated in FIG. 3 and a droplet number subtraction amount table 32 illustrated in FIG. 4. The storage 5 includes a storage device such as a HDD or a semiconductor memory. The storage 5 stores commands which, when executed by a processor such as a CPU, causes the processor to perform the processing to be described later.

The maximum droplet number table 31 is a table in which a sheet type and a print resolution (print conditions) are associated with a standard maximum droplet number. The standard maximum droplet number is the maximum droplet number determined depending on the sheet type and the print resolution. The maximum droplet number is the maximum number of droplets of an ink of each color per pixel. The larger the receivable ink amount of the sheet type is, the larger the standard maximum droplet number is. In the example of FIG. 3, the standard maximum droplet number of a gloss sheet with the largest receivable ink amount is the largest, and the standard maximum droplet number of an ordinary sheet with the smallest receivable ink amount is the smallest. Moreover, the higher the print resolution is, the larger the number of pixels per unit area is and thus the smaller the standard maximum droplet number is. In the example of FIG. 3, the standard maximum droplet number for the print resolution of 600 dpi is smaller than that for the print resolution of 300 dpi in the same sheet type.

The droplet number subtraction amount table 32 is a table in which a print speed mode is associated with a droplet subtraction number which is used to change the maximum droplet number in the printing from the standard maximum droplet number to a different number depending on the print speed mode.

The print speed mode is a mode for use to set a print speed. The print speed is expressed by the number of pages printed per unit time, specifically, the number of pages printed per minute (ppm). The larger the number of pages printed per minute is, the higher the print speed is. The print speed can be increased by increasing the conveyance speed of the sheet P by the conveyor 2 in the printing.

Figures 4, 5:
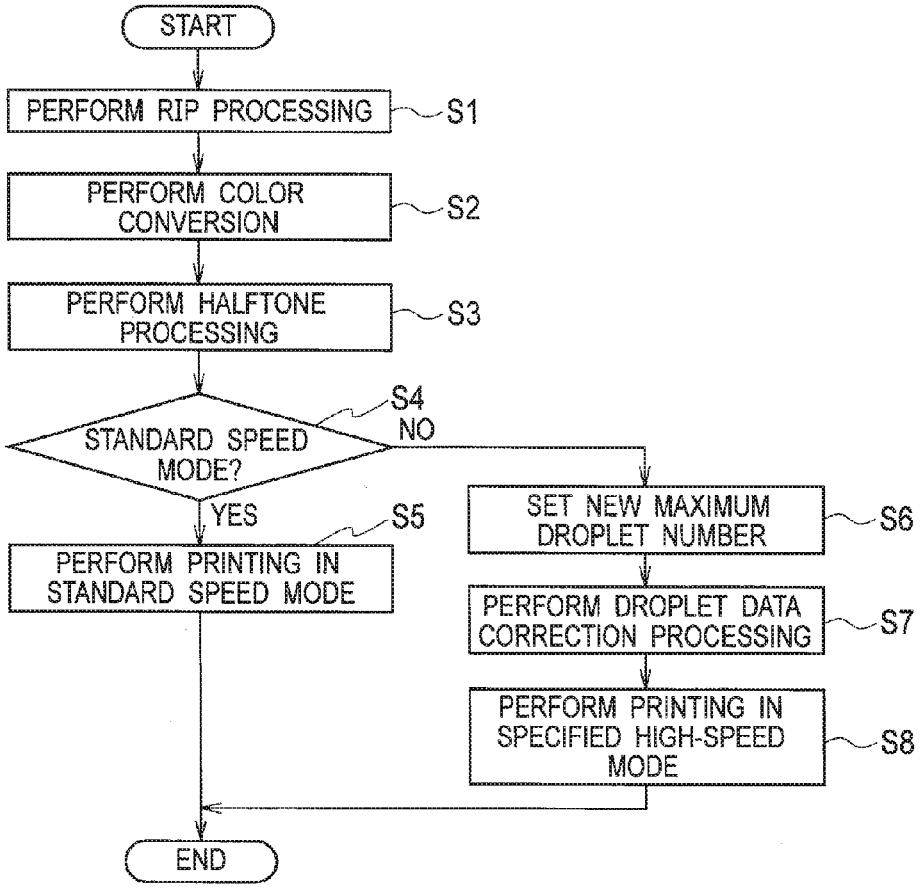
FIG. 4 is a diagram illustrating a droplet number subtraction amount table.
FIG. 5 is a flowchart for explaining operations of the inkjet printing apparatus illustrated in FIG. 1.

As illustrated in FIG. 4, the inkjet printing apparatus 1 is provided with, as the print speed modes, a standard mode and first to third high-speed modes which are high-speed modes. The standard mode is a mode in which the printing is performed with the conveyance speed of the sheet P by the conveyor 2 set to a conveyance speed for the standard maximum droplet number. The first to third high-speed modes are each a mode in which the printing is performed with the conveyance speed of the sheet P by the conveyor 2 set to a conveyance speed for a new maximum droplet number which is obtained by subtracting a certain droplet number from the standard maximum droplet number.

The smaller the maximum droplet number in the printing is, the shorter the time required from the start to the end of ejection for one pixel is. Accordingly, the conveyance speed of the sheet P can be increased by reducing the maximum droplet number. In view of this, as illustrated in FIG. 4, the droplet numbers obtained by subtracting 1, 2, and 3 from the standard maximum droplet number are set respectively as the maximum droplet numbers in the printing in the first high-speed mode, the second high-speed mode, and the third high-speed mode. The conveyance speed of the sheet P by the conveyor 2 in each of the first to third high-speed modes is thereby increased from that in the standard mode, and the print speed is thus increased. In the high-speed modes, the maximum droplet number in the printing becomes smaller in the order of the first high-speed mode, the second high-speed mode, and the third high-speed mode. Accordingly, the conveyance speed of the sheet P in the printing in the third high-speed mode is the highest and the print speed in the third high-speed mode is thus the highest.

Note that, since the standard maximum droplet number varies depending on the sheet type and the print resolution as illustrated in FIG. 3, the maximum droplet number in the printing in each of the standard mode and the first to third high-speed modes varies depending the sheet type and the print resolution. Thus, the conveyance speed of the sheet P and the print speed in the printing in each of the standard mode and the first to third high-speed modes vary depending on the sheet type and the print resolution. Moreover, since there is a limit to the droplet number which can be subtracted from the standard maximum droplet number, there is a case where at least one of the second and third high-speed modes cannot be selected, depending on the sheet type and the print resolution.

The controller 6 controls the operation of the entire inkjet printing apparatus 1. The controller 6 includes a CPU, a RAM, a ROM, and the like. The controller 6 includes a conveyance controller 41, an image processor 42, a print controller 43, and a display controller 44. These units of the controller 6 can be implemented by causing the CPU to operate according to the programs (commands) stored in the storage 5.

The conveyance controller 41 controls the conveyor 2 to cause the conveyor 2 to convey the sheet P.

The image processor 42 generates droplet data for each of the ink colors of C, M, Y, and K, based on print job data of a page description language (PDL) format sent from an external personal computer or the like. The droplet data for each color is data indicating the droplet number of the ink of the color for each pixel. The image processor 42 includes a raster image processor (RIP) 51, a color convertor 52, a halftone processor 53, a maximum droplet number setting changer 54, and a droplet data corrector 55.

The RIP 51 performs RIP processing on the print job data to generate RGB image data. The RIP processing is processing in which the print job data is subjected to syntax analysis and then rasterized to generate the image data.

The color convertor 52 converts the RGB image data Generated by the RIP 51 into CMYK image data. This color conversion can be performed by using a table in which correspondences between RGB values and CMYK values are recorded in advance.

The halftone processor 53 performs halftone processing on the image data for each of the colors of CMYK to generate droplet data for each color. Error diffusion processing or dither mask processing can be employed as the halftone processing. The halftone processor 53 generates the droplet data in which the maximum droplet number is set to the standard maximum droplet number corresponding to the sheet type and the print resolution. In other words, the halftone processor 53 generates droplet data in which the upper limit of the droplet number per pixel is set to the standard maximum droplet number.

The maximum droplet number setting changer 54 sets (determines) the maximum droplet number in the printing to a new maximum droplet number smaller than the maximum droplet number corresponding to the print conditions, when any of the first to third high-speed modes is specified as the print speed mode. Specifically, the maximum droplet number setting changer 54 sets the maximum droplet number in the printing in each of the first to third high-speed modes to a new maximum droplet number smaller than the standard maximum droplet number corresponding to the sheet type and the print resolution. The new maximum droplet number in each of the first to third high-speed modes is a droplet number obtained by subtracting, from the standard maximum droplet number, the droplet subtraction number associated with the corresponding mode in the droplet number subtraction amount table 32.

The droplet data corrector 55 performs droplet data correction processing when the print speed mode is any of the first to third high-speed modes. The droplet data correction processing is processing of correcting the droplet data for each color generated by the halftone processor 53 such that the maximum droplet number of the ink per pixel is corrected to the new maximum droplet number.

Specifically, the droplet data corrector 55 changes the droplet numbers which are for the pixels in the droplet data for each color generated by the halftone processor 53 and which are larger than the new maximum droplet number, to the new maximum droplet number. Moreover, for a certain pixel for which the droplet number is decreased to the new maximum droplet number in the droplet data for black, the droplet data corrector 55 distributes a droplet subtracted to decrease the black droplet number for the certain pixel to a pixel surrounding the certain pixel in the droplet data for black or replaces the subtracted droplet with droplets for the certain pixel in the droplet data for the other colors.

The print controller 43 controls the inkjet heads 21C, 21K, 21M, and 21Y of the printer 3 based on the pieces of droplet data for the respective colors, to cause the inkjet heads 21C, 21K, 21M, and 21Y to eject the inks of the respective colors. In the standard mode, the print controller 43 controls the inkjet heads 21C, 21K, 21M, and 21Y based on the pieces of droplet data for the respective colors generated by the halftone processor 53. In the first to third high-speed modes, the print controller 43 controls the inkjet heads 21C, 21K, 21M, and 21Y based on the pieces of droplet data for the respective colors corrected by the droplet data corrector 55.

The display controller 44 performs display control of the display 26 in the operation panel 4.

Next, operations of the inkjet printing apparatus 1 are described.

FIG. 5 is a flowchart for explaining the operations of the inkjet printing apparatus 1. The processing in the flowchart of FIG. 5 starts when the inkjet printing apparatus 1 receives the print job data of the PDL format.

In step S1 of FIG. 5, the RIP 51 of the image processor 42 performs the RIP processing on the print job data to generate the RGB image data. In this case, the RIP 51 obtains information indicating the sheet type and the print resolution to be used in the printing from the print job data, by performing the RIP processing. Then, the RIP 51 generates the image data of the obtained print resolution.

Next, in step S2, the color convertor 52 converts the RGB image data generated in the RIP 51 to the CMYK image data.

Then, in step S3, the halftone processor 53 performs the halftone processing on the image data for each of the colors of CMYK to generate the droplet data for each color. Specifically, the halftone processor 53 obtains the information indicating the sheet type and the print resolution to be used in the printing from the RIP 51, and obtains the standard maximum droplet number corresponding to the sheet type and the print resolution from the maximum droplet number table 31. Then, the halftone processor 53 performs the halftone processing on the image data for each of the colors of CMYK such that the maximum droplet number is set to the standard maximum droplet number corresponding to the sheet type and the print resolution, and generates the droplet data for each color.

Next, in step S4, the maximum droplet number setting changer 54 determines whether the specified print speed mode is the standard mode. In this case, the print speed mode is specified in advance. For example, the user specifies the print speed mode by performing input operations on the input unit 27 while viewing a print speed setting screen (not illustrated) displayed on the display 26 of the operation panel 4.

When the maximum droplet number setting changer 54 determines that the specified print speed mode is the standard mode (step S4: YES), in step S5, the controller 6 performs printing in the standard mode.

Specifically, the maximum droplet number setting changer 54 obtains the information indicating the sheet type and the print resolution to be used in the printing from the RIP 51, and obtains the standard maximum droplet number corresponding to the sheet type and the print resolution from the maximum droplet number table 31. The maximum droplet number setting changer 54 notifies the conveyance controller 41 and the print controller 43 of the standard maximum droplet number corresponding to the sheet type and the print resolution, as the maximum droplet number in this printing, without changing the maximum droplet number in the printing from the standard maximum droplet number. The halftone processor 53 sends the generated droplet data for each color to the print controller 43.

The conveyance controller 41 drives the conveyor 2 such that the conveyance speed of the sheet P becomes the conveyance speed for the standard maximum droplet number corresponding to the sheet type and the print resolution which is the maximum droplet number in this printing.

The sheets P are sequentially fed from the not-illustrated paper feeder to the conveyor 2 at time intervals for achieving a print speed corresponding to the conveyance speed of the sheet P for the standard maximum droplet number. The sheets P fed to the conveyor 2 are conveyed by the conveyor belt 11 of the conveyor 2.

The print controller 43 controls the inkjet heads 21C, 21K, 21M, and 21Y based on the pieces droplet data for the respective colors generated by the halftone processor 53, to cause the inkjet heads 21C, 21K, 21M, and 21Y to eject the inks to the sheets P conveyed by the conveyor 2. Images are thereby printed on the sheets P. In this case, the print controller 43 controls the inkjet heads 21C, 21K, 21M, and 21Y such that an ejection operation for each line of the images is performed at a timing corresponding to the conveyance speed of the sheet P for the maximum droplet number in this printing.

When the printing of a certain number of sheets is completed, the conveyance controller 41 stops the conveyor 2 and the series of operations is completed.

When the maximum droplet number setting changer 54 determines that the specified print speed mode is one of the first to third high-speed modes in step S4 (step S4: NO), in step S6, the maximum droplet number setting changer 54 sets the new maximum droplet number.

Specifically, the maximum droplet number setting changer 54 obtains the information indicating the sheet type and the print resolution to be used in the printing from the RIP 51, and obtains the standard maximum droplet number corresponding to the sheet type and the print resolution from the maximum droplet number table 31. Then, the maximum droplet number setting changer 54 selects and obtains the droplet subtraction number corresponding to the specified one of the first to third high-speed modes from the droplet number subtraction amount table 32. Next, the maximum droplet number setting changer 54 sets the new maximum droplet number to a droplet number obtained by subtracting the droplet subtraction number associated with the specified mode from the standard maximum droplet number associated with the sheet type and the print resolution.

Next, in step S7, the droplet data corrector 55 performs the droplet data correction processing. Contents of the droplet data correction processing are described later.

Then, in step S8, the controller 6 performs printing in the specified one of the high-speed modes (first to third high-speed modes).

Specifically, the maximum droplet number setting changer 54 notifies the conveyance controller 41 and the print controller 43 of the new maximum droplet number, as the maximum droplet number in this printing. Moreover, the print controller 43 receives the droplet data for each color which is corrected by the droplet data corrector 55. In this case, the droplet data for each color which is corrected by the droplet data corrector 55 is data in which the maximum droplet number of the ink per pixel is set to the new maximum droplet number set in step S6.

The conveyance controller 41 drives the conveyor 2 such that the conveyance speed of the sheet P becomes the conveyance speed for the new maximum droplet number.

The sheets P are sequentially fed from the not-illustrated paper feeder to the conveyor 2 at time intervals for achieving a print speed corresponding to the conveyance speed of the sheet P for the new maximum droplet number. The sheets P fed to the conveyor 2 are conveyed by the conveyor belt 11 of the conveyor 2.

The print controller 43 controls the inkjet heads 21C, 21K, 21M, and 21Y based on the pieces of droplet data for the respective colors corrected by the droplet data corrector 55, to cause the inkjet heads 21C, 21K, 21M, and 21Y to eject the inks to each of the sheets P conveyed by the conveyor 2. Images are thereby printed on the sheets P. In this case, the print controller 43 controls the inkjet heads 21C, 21K, 21M, and 21Y such that the ejection operation for each line of the images is performed at a timing corresponding to the conveyance speed of the sheet P for the maximum droplet number in this printing.

When the printing of a certain number of sheets is completed, the conveyance controller 41 stops the conveyor 2 and the series of operations is completed.

Next, the aforementioned droplet data correction processing performed in step S7 of FIG. 5 is described with reference to the flowchart of FIG. 6.

Figure 6:
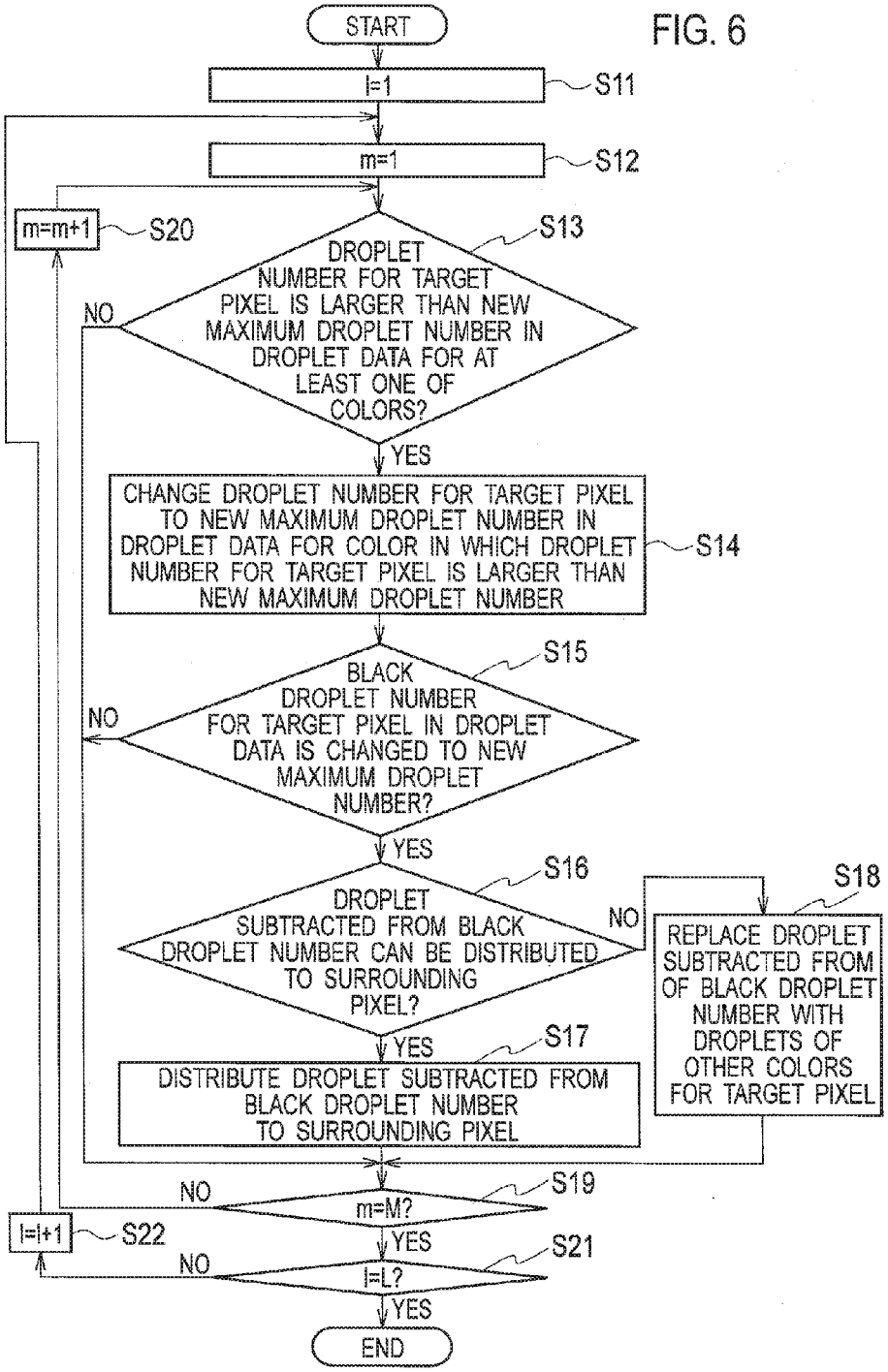
FIG. 6 is a flowchart of droplet data correction processing.

In step S11 of FIG. 6, the droplet data corrector 55 sets a variable l indicating a line number in the droplet data to "1."

Then, in step S12, the droplet data corrector 55 sets a variable m indicating a pixel number on a line to "1."

Next, in step S13, the droplet data corrector 55 determines whether the droplet number for a target pixel which is the m-th pixel in the l-th line is larger than the new maximum droplet number in at least one of the pieces of droplet data for the respective colors. The new maximum droplet number is the number set by the maximum droplet number setting changer 54 in step S6 of FIG. 5 described above.

When the droplet data corrector 55 determines that the droplet number for the target pixel is smaller than the new maximum droplet number in all pieces of droplet data for the respective colors (step S13: NO), the droplet data corrector 55 proceeds to step S19.

When the droplet data corrector 55 determines that the droplet number for the target pixel is larger than the new maximum droplet number in at least one of the pieces of droplet data for the respective colors (step S13: YES), in step S14, the droplet data corrector 55 changes the droplet number for the target pixel to the new maximum droplet number in the droplet data for a color in which the droplet number for the target pixel is larger than the new maximum droplet number.

Then, in step S15, the droplet data corrector 55 determines whether the droplet number for the target pixel is decreased to the new maximum droplet number in the droplet data for black in the processing of step S14. When the droplet data corrector 55 determines that the droplet number for the target pixel is not decreased in the droplet data for black (step S15: NO), the droplet data corrector 55 proceeds to step S19.

When the droplet data corrector 55 determines that the droplet number for the target pixel is decreased to the new maximum droplet number in the droplet data for black (step S15: YES), in step S16, the droplet data corrector 55 determines whether a droplet subtracted to decrease the black droplet number for the target pixel can be distributed to any of the surrounding pixel.

Specifically, the droplet data corrector 55 sets pixels to be scanned after the target pixel out of the pixels surrounding the target pixel as distribution candidate pixels. The distribution candidate pixels are, specifically, the (m+1)th pixel in the l-th line, the (m−1)th pixel in the (l+1)th line, the m-th pixel in the (l+1)th line, and the (m+1)th pixel in the (l+1) line.

Then, the droplet data corrector 55 determines whether the following condition is satisfied: the total of differences between the new maximum droplet number and the black droplet number for the distribution candidate pixels the black droplet number for which is not zero and is smaller than the new maximum droplet number is equal to or larger than the number of droplets subtracted to decrease the black droplet number for the target pixel. When this condition is satisfied, the droplet data corrector 55 determines that the droplet subtracted to decrease the black droplet number for the target pixel can be distributed to the surrounding pixel.

Satisfying the aforementioned condition means that the droplet subtracted to decrease the black droplet number for the target pixel can be distributed to at least one of the distribution candidate pixels the black droplet number for which is not zero, without the droplet numbers for the pixels exceeding the new maximum droplet number due to the distribution.

When the droplet data corrector 55 determines that the droplet subtracted to decrease the black droplet number for the target pixel can be distributed to the surrounding pixel (step S16: YES), in step S17, the droplet data corrector 55 distributes the droplet subtracted to decrease the black droplet number for the target pixel to the surrounding pixel. Specifically, the droplet data corrector 55 distributes the droplet subtracted to decrease the black droplet number for the target pixel to at least one of the distribution candidate pixels in which the black droplet number is not zero and is smaller than the new maximum droplet number. Then, the droplet data corrector 55 proceeds to step S19.

When there are multiple distribution candidate pixels in which the black droplet number is not zero and is smaller than the new maximum droplet number, for example, the droplet is distributed preferentially to the distribution candidate pixel with the largest droplet number. This can suppress a change in the image density.

The droplet is not distributed to the pixels the black droplet number for which is zero to avoid the change in the image density which is caused by ejecting the black ink to pixels for which no black ink is originally ejected.

A specific example in which the droplet subtracted to decrease the black droplet number for the target pixel is distributed to the surrounding pixel is described with reference to FIGS. 7A and 7B.

Figure 7A:
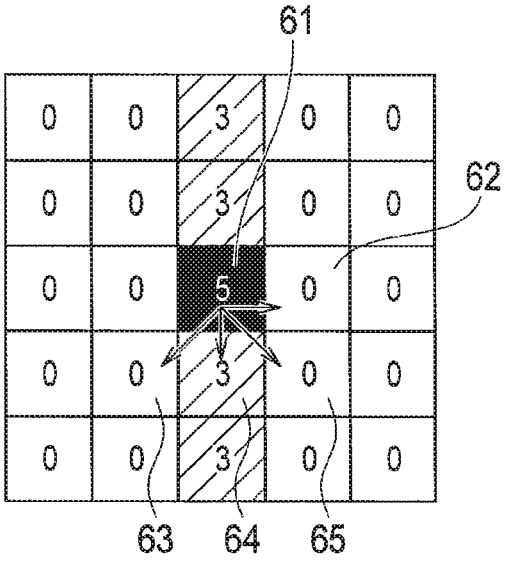
FIG. 7A is a diagram for explaining a specific example in which a droplet subtracted to decrease a black droplet number for a target pixel is distributed to a surrounding pixel.
Figure 7B:
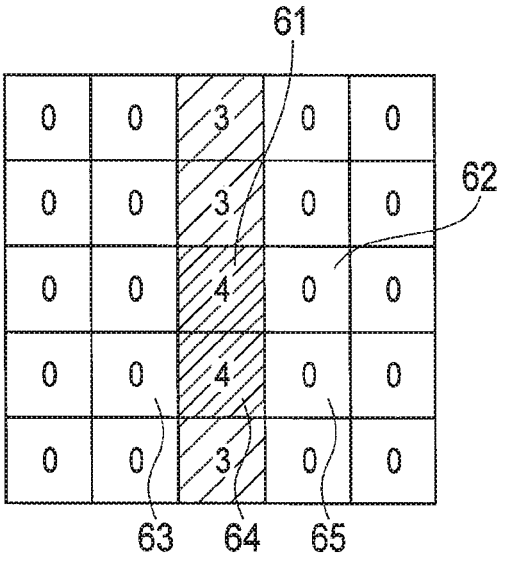
FIG. 7B is a diagram for explaining the specific example in which the droplet subtracted to decrease the black droplet number for the target pixel is distributed to the surrounding pixel.

In FIGS. 7A and 7B, the squares indicate the pixels. The number depicted in each square indicates the ink droplet number for the corresponding pixel. In the example of FIGS.

7A and 7B, the standard maximum droplet number is 5, and the new maximum droplet number is 4.

FIG. 7A is a view illustrating a state before the droplet number change is performed on a target pixel 61 the droplet number for which is 5 being the standard maximum droplet number. Since the new maximum droplet number is 4, the target pixel 61 is a target of the droplet number change (subtraction). The number of droplets subtracted to decrease the droplet number for the target pixel 61 in the droplet number change is one droplet.

In the droplet data correction processing, the scanning of pixels is performed from left to right and from top to bottom in the droplet data of FIG. 7A. Accordingly, pixels 62 to 65 pointed by the arrows in FIG. 7A are the distribution candidate pixels to which the droplet subtracted to decrease the droplet number for the target pixel 61 is to be distributed. The pixel 62 corresponds to the (m+1)th pixel in the l-th line, the pixel 63 corresponds to the (m−1)th pixel in the (l+1)th line, the pixel 64 corresponds to the m-th pixel in the (l+1)th line, and the pixel 65 corresponds to the (m+1)th pixel in the (l+1) line.

Out of the pixels 62 to 65 being the distribution candidate pixels, the only pixel the black droplet number for which is not zero and is smaller than 4, that is the new maximum droplet number is the pixel 64 the droplet number for which is 3. The difference between the droplet number for the pixel 64 and the new maximum droplet number is one droplet. Since the difference between the droplet number (3) for the pixel 64 and the new maximum droplet number (4) is equal to larger than the decrease (1) of the droplet number for the target pixel 61 in the droplet number change, the aforementioned condition is satisfied. Hence, in this case, the droplet data corrector 55 determines that the droplet subtracted to decrease the black droplet number for the target pixel can be distributed to the surrounding pixel.

Then, after the droplet number change in the target pixel 61, one droplet which is the droplet subtracted to decrease the droplet number for the target pixel 61 is distributed (added) to the pixel 64 and the state illustrated in FIG. 7B is obtained.

In the embodiment, in order to facilitate the processing, the distribution candidate pixels to which the droplet subtracted to decrease the droplet number for the target pixel is to be distributed are set to be the pixels surrounding the target pixel which are to be scanned after the target pixel. However, processing may be such that the decrease is distributed to other surrounding pixel.

Returning to FIG. 6, when the droplet data corrector 55 determines that the droplet subtracted to decrease the black droplet number for the target pixel cannot be distributed to the surrounding pixels in step S16 (step S16: NO), in step S18, the droplet data corrector 55 replaces the droplet subtracted to decrease the black droplet number for the target pixel with droplets of other colors for the target pixel.

For example, when the number of droplets subtracted to decrease the black droplet number for the target pixel is one droplet, the droplet data corrector 55 adds one droplet to the droplet number for the target pixel in the droplet data for each of the colors of cyan, magenta, and yellow. The density is thereby compensated by the inks of the other colors, and this can suppress a decrease of the density of a color close to black in the printed image.

After step S18, the droplet data corrector 55 proceeds to step S19. In step S19, the droplet data corrector 55 determines whether the variable m is M indicating the last pixel in the l-th line.

When the droplet data corrector 55 determines that m is not M (step S19: NO), in step S20, the droplet data corrector 55 adds "1" to the variable m. Thereafter, the droplet data corrector 55 returns to step S13.

When the droplet data corrector 55 determines that m is M (step S19: YES), in step S21, the droplet data corrector 55 determines whether the variable l is L indicating the last line.

When the droplet data corrector 55 determines that l is not L (step S21: NO), in step S22, the droplet data corrector 55 adds "1" to the variable l. Thereafter, the droplet data corrector 55 returns to step S12.

When the droplet data corrector 55 determines that l is L (step S21: YES), the droplet data corrector 55 terminates the droplet data correction processing.

Next, how the usage amounts of the inks of the respective colors change due to the aforementioned droplet data correction processing is described with reference to FIGS. 8A and 8B.

FIG. 8A is a table depicting an example of the amounts of the inks of the respective colors used to achieve major colors in printing when no droplet data correction processing is performed. FIG. 8B is a table depicting an example of the amounts of the inks of the respective colors used to achieve the major colors in printing when the droplet data correction processing is performed on the droplet data in the example of FIG. 8A.

In the examples of FIGS. 8A and 8B, an upper limit of a total ink amount is set to 160%. In the example of FIG. 8A, the maximum droplet number (standard maximum droplet number) is 5. In the example of FIG. 8B, the maximum droplet number (new maximum droplet number) is 4.

The total ink amount is a value indicating the total of the amounts of the inks of the respective colors used per pixel (ink usages). The ink usages are each calculated according to the droplet number, with the maximum droplet number corresponding to the sheet type and the print resolution (standard maximum droplet number) being 100%. In the examples of FIGS. 8A and 8B, five droplets correspond to the ink usage of 100%. When the number of ejected droplets is the maximum droplet number corresponding to the sheet type and the print resolution for all four colors of CMYK, the total ink amount reaches 400%.

Generally, from the views point of suppressing ink penetration to the back side of the sheet and turbidity in coloring caused by an excessive amount of inks, the upper limit of the total ink amount is set. The droplet data for each color is generated such that the total ink amount per pixel is equal to or smaller than the upper limit.

As illustrated in FIGS. 8A and 8B, when the color to be achieved is black, performing droplet data correction processing reduces the black ink usage, and a decrease in the black ink usage is replaced with the ink usages of the other colors (cyan, magenta, and yellow). This can suppress the decrease in the density of the black print color while reducing the maximum droplet number of the black ink.

Moreover, as illustrated in FIGS. 8A and 8B, when the color to be achieved is cyan, performing the droplet data correction processing reduces the maximum droplet number of cyan and thereby reduces the cyan ink usage. This is the same for magenta and yellow. In the droplet data correction processing, the inks of the other colors are not substituted for bright colors such as cyan, magenta, and yellow to prevent loss of balance of colors.

Note that, when the color to be achieved is red, green, or blue, as illustrated in FIG. 8A, the ink usages of the respective inks used in printings when no droplet data correction processing is performed are 80%. The droplet number corresponding to the ink usage of 80% is 4, and this is the same as the new maximum droplet number (4) used when the droplet data correction processing is performed. Accordingly, when the color to be achieved is red, green, or blue, as illustrated in FIGS. 8A and 8B, no ink usages are changed in the droplet data correction processing.

As described above, in the inkjet printing apparatus 1, the maximum droplet number setting changer 54 sets the new maximum droplet number smaller than the standard maximum droplet number in the high-speed modes. The droplet data corrector 55 corrects the droplet data for each color such that the maximum droplet number per pixel is set to the new maximum droplet number. The conveyance controller 41 drives the conveyor 2 such that the conveyance speed of the sheet P becomes the conveyance speed for the new maximum droplet number. The print controller 43 controls the inkjet heads 21C, 21K, 21M, and 21Y, based on the pieces of droplet data for the respective colors which are corrected by the droplet data corrector 55, to cause the inkjet heads 21C, 21K, 21M, and 21Y to eject the inks to the sheet P conveyed by the conveyor 2. The printing is thereby performed while the sheet P is conveyed at the conveyance speed for the new maximum droplet number, and the printing can be thus performed with the conveyance speed of the sheet P increased. As a result, it is possible to improve the productivity of printed sheets.

Moreover, in the inkjet printing apparatus 1, for a certain pixel for which the droplet number is decreased to the new maximum droplet number in the droplet data for black, the droplet data corrector 55 distributes a droplet subtracted to decrease the black droplet number for the certain pixel to any of the pixels surrounding it in the droplet data for black or replaces the subtracted droplets with droplets for the certain pixel in the droplet data for the other colors. This can suppress a decrease in the amount of ink(s) used to achieve a color close to black when the maximum droplet number in the printing is reduced. Hence, a decrease in the density of the color close to black in a printed image can be suppressed.

Accordingly, the inkjet printing apparatus 1 can improve the productivity of printed sheets while suppressing a decrease in print quality.

Moreover, in the inkjet printing apparatus 1, the maximum droplet number setting changer 54 can select and set one of multiple droplet numbers as the new maximum droplet number. Specifically, the maximum droplet number setting changer 54 selects and obtains the droplet subtraction number associated with the specified one of the first to third high-speed modes, from the droplet number subtraction amount table 32, and sets the new maximum droplet number by using the droplet subtraction number. The user or the like can thereby select and set one of the multiple print speeds (productivity) and the print image quality corresponding thereto, and the usability is thus improved.

Note that, in the embodiment described above, the droplet subtracted to decrease the black droplet number for the pixel in which the droplet number is decreased to the new maximum droplet number in the droplet data for black is distributed to any of the pixels surrounding this pixel in the droplet data for black or replaced with droplets for this pixel in the droplet data for the other colors. However, it is possible to combine the processing of distributing the droplet subtracted to decrease the black droplet number for the pixel in which the droplet number is decreased to the new maximum droplet number to the pixels surrounding this pixel in the droplet data for black and the processing of replacing the subtracted droplet with droplets for this pixel in the droplet data for other colors. Specifically, it is only necessary that, for each of the pixels in which the black droplet number is decreased to the new maximum droplet number, there is performed at least one of the processing of distributing the droplet subtracted to decrease the black droplet number for this pixel to any of the pixels surrounding this pixel in the droplet data for black and the processing of replacing the subtracted droplet with droplets for this pixel in the droplet data for the other colors.

Moreover, in the inkjet printing apparatus 1, when black and white printing is set, one of the first to third high-speed modes may be automatically selected.

Moreover, although the sheet type and the print resolution are given as elements of the print conditions used to determine the standard maximum droplet number in the aforementioned embodiment, the elements of the print conditions used to determine the standard maximum droplet number are not limited to this combination. For example, the print resolution may be omitted from the elements of the print conditions used to determine the standard maximum droplet number.

Moreover, although the inkjet printing apparatus 1 which performs printing by ejecting the inks of four colors of cyan, black, magenta, and yellow is described in the aforementioned embodiment, the number and combination of ink colors are not limited to these. It is only necessary that the inkjet printing apparatus uses inks of multiple colors including black.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing apparatus, comprising:

a conveyor configured to convey a sheet;

a printer including a multi-drop inkjet head and configured to eject inks of multiple colors including black onto the sheet conveyed by the conveyor from the inkjet head to perform printing on the sheet; and a controller configured to control the conveyor and the printer, wherein the controller is configured to:

determine a maximum droplet number of an ink of each color per pixel to be a second maximum droplet number smaller than a first maximum droplet number corresponding to a print condition;

correct first droplet data for each ink color to second droplet data for each ink color, the first droplet data indicating a droplet number of the ink per pixel with the first maximum droplet number set as maximum, the second droplet data indicating the droplet number of the ink per pixel with the second maximum droplet number set as maximum;

control the conveyor to convey the sheet at a conveyance speed for the second maximum droplet number; and control the printer to eject the inks of the respective colors from the inkjet head based on the second droplet data, correcting the first droplet data to the second droplet data includes:

changing a droplet number larger than the second maximum droplet number among droplet numbers in the first droplet data for each ink color, to the second maximum droplet number; and for each of certain pixels with the droplet number of black decreased to the second maximum droplet number, performing at least one of a first processing or a second processing, the first processing including distributing a droplet number subtracted to decrease the droplet number of black to pixels surrounding the certain pixel in the first droplet data for black, the second processing including adding the subtracted droplet number to a droplet number for the certain pixel in the first droplet data for a color other than black.

2. The inkjet printing apparatus according to claim 1, wherein the controller selects and determines one of a plurality of droplet numbers as the second maximum droplet number.

3. The inkjet printing apparatus according to claim 1, wherein the print condition includes at least one of a type of the sheet and a print resolution.

4. The inkjet printing apparatus according to claim 1, wherein the conveyance speed for the second maximum droplet number is higher than a conveyance speed for the first maximum droplet number.

5. The inkjet printing apparatus according to claim 1, further comprising a storage storing a first table and a second table, the first table associating the print condition with the first maximum droplet number, the second table associating each of a plurality of print speed modes for use to set a print speed with a droplet subtraction number for correcting the first droplet data to the second droplet data.

6. The inkjet printing apparatus according to claim 1, wherein, in the first processing, the controller is configured to distribute the subtracted droplet number preferentially to a pixel with a larger droplet number among the pixels surrounding the certain pixel.

* * * * *